US009599128B2

(12) United States Patent
Bartholomeus

(10) Patent No.: US 9,599,128 B2
(45) Date of Patent: Mar. 21, 2017

(54) PISTON PUMP AND MOTOR

(71) Applicant: Th. Witt Kaeltemaschinenfabrik GmbH, Aachen (DE)

(72) Inventor: Titus Bartholomeus, HS Sittard (NL)

(73) Assignee: TherMass Innovations B.V., HS Sittard (NL)

( * ) Notice: Subject to any disclaimer, the term of this patent is extended or adjusted under 35 U.S.C. 154(b) by 304 days.

(21) Appl. No.: 14/250,661

(22) Filed: Apr. 11, 2014

(65) Prior Publication Data

US 2014/0311334 A1 Oct. 23, 2014

Related U.S. Application Data

(63) Continuation of application No. PCT/NL2012/050711, filed on Oct. 11, 2012.

(30) Foreign Application Priority Data

Oct. 12, 2011 (NL) ..... 2007584

(51) Int. Cl.
*F15B 15/02* (2006.01)
*F04B 9/107* (2006.01)
(Continued)

(52) U.S. Cl.
CPC ..... *F15B 15/02* (2013.01); *F01B 11/002* (2013.01); *F01B 11/007* (2013.01);
(Continued)

(58) Field of Classification Search
CPC .... F15B 15/02; F15B 9/08; F04B 9/08; F04B 9/1076; F04B 9/1276; F04B 9/10; F04B 9/103; F04B 9/107; F04B 9/123; F04B 9/127; F04B 15/04; F04B 15/06; F01B 11/002; F01B 11/007; F03C 1/0073; F03C 1/035; B25D 9/12
(Continued)

(56) References Cited

U.S. PATENT DOCUMENTS 4,945,725 A 8/1990 Carmein et al.
5,036,811 A * 8/1991 Weiss ..... F01L 13/06 123/323
7,249,458 B2 * 7/2007 Arbel ..... F04B 1/07 60/415

FOREIGN PATENT DOCUMENTS

DE 1086088 B 7/1960
DE 1249594 B 9/1967

* cited by examiner

*Primary Examiner* — Logan Kraft
(74) *Attorney, Agent, or Firm* — Von Rohrscheidt Patents

(57) ABSTRACT

A plunger pump or plunger motor includes a block accommodating a first cylindrical chamber and a plunger movable in this chamber and a drive shaft connected to this plunger, as well as a second cylindrical chamber and a control valve movable in this second cylindrical chamber. Holes $O_3$ and $O_4$ can alternately be brought into communication with the connection for the delivery pipe by the plunger and with a connecting hole for a pressure line. The control valve can establish a communication between the hole $O_2$ and the connecting hole. The drive shaft is connected to a further plunger which is movable in a third cylindrical chamber in which there is a suction hole or delivery hole. The control valve can alternately establish a communication between the suction hole or delivery hole with a connecting hole for a suction pipe and the connecting hole for the pressure line.

10 Claims, 3 Drawing Sheets

(51) Int. Cl.

| | |
|---|---|
| ***F15B 9/08*** | (2006.01) |
| ***F01B 11/00*** | (2006.01) |
| ***F04B 9/127*** | (2006.01) |
| ***F03C 1/007*** | (2006.01) |
| ***F03C 1/03*** | (2006.01) |
| ***F04B 9/08*** | (2006.01) |
| ***F04B 15/06*** | (2006.01) |

(52) U.S. Cl.
CPC ..... *F03C 1/0073* (2013.01); *F03C 1/035* (2013.01); *F04B 9/08* (2013.01); *F04B 9/107* (2013.01); *F04B 9/1076* (2013.01); *F04B 9/127* (2013.01); *F04B 9/1276* (2013.01); *F04B 15/06* (2013.01); *F15B 9/08* (2013.01)

(58) Field of Classification Search
USPC ..... 91/281, 282, 283, 319; 173/206, 207; 417/376, 399, 401, 403
See application file for complete search history.

PISTON PUMP AND MOTOR

RELATED APPLICATIONS

This application is a continuation of International application PCT/NL2012/050711 filed on Oct. 11, 2012 claiming priority from Dutch application NL 2007584 filed on Oct. 12, 2011, both of which are incorporated in their entirety by this reference.

FIELD OF THE INVENTION

The invention relates to a plunger pump or plunger motor. In case of a plunger motor a drive shaft drives for example a mechanism that converts a translating movement into a rotating movement, and in case of a plunger pump the drive shaft drives for example a piston that provides the pumping action.

BACKGROUND OF THE INVENTION

A plunger pump or plunger motor of this general type is known. In the known plunger pump or plunger motor a valve has a separate power supply for the purpose of moving a control valve.

BRIEF SUMMARY OF THE INVENTION

It is an object of the invention to provide a plunger pump or plunger motor which is simpler than the known plunger pump or plunger motor.

The object is achieved by a plunger pump or plunger motor comprising a motor casing having a first cylindrical chamber and a plunger movable in this chamber with a drive shaft attached to a first plunger side, so that the plunger surface on the first side is smaller than on an opposite second side, a first and a second hole being provided in the motor casing at such a location that in any position of the plunger one hole is available on either side of the plunger, and which plunger pump or plunger motor comprises a valve including a valve casing having a second cylindrical chamber and a control valve movable in this chamber, which valve can establish a communication between a connecting hole for a delivery pipe and the second hole.

To this end the plunger pump or plunger motor according to the invention is characterized in that the valve casing has a first further hole and a second further hole at such a location that in any position of the control valve one further hole is available on either side of the control valve, while furthermore the motor casing has a third and a fourth hole, where the third hole communicates with the first further hole in the valve casing and the fourth hole communicates with the second further hole in the valve casing, which third and fourth holes can alternately be brought into communication with the connecting hole for the delivery pipe by the plunger. The operation of the valve in the plunger pump or plunger motor according to the invention does not require an external power supply, but the valve is fed by the same delivery pipe as the one for feeding the plunger motor, so that a simple configuration is achieved.

The plunger pump or plunger motor according to the invention is pre-eminently suitable for circulating boiling liquids. Boiling liquids are often circulated by means of rotating pumps (centrifugal and side channel or a combination thereof) which are coupled to an electric drive motor. Owing to the injurious effect of the liquid to be circulated on humans and the environment, the coupling between pump and motor has to be leak-proof. These are usually costly and wear-sensitive solutions which have dismal efficiency. Alternatively, so-called pumper drums are utilized, which are called montejus in process technology. For circulating the liquid, compressed gas or flash gas is then used in lieu of compressed air. A disadvantage of this solution is that many fittings are needed, that the solution is energetically poor and that delivery is effected periodically.

The plunger pump/plunger motor according to the invention provides a cost effective solution for circulating boiling liquids with:

1. minimum energy consumption
2. minimum NPSH value; and
3. possibility of being maintenance free.

Condition 1 is satisfied by making use of a flash gas fed expander motor, condition 2 is satisfied by minimizing flow losses in the pump and condition 3 is satisfied by striving for a minimum number of component parts (hence also the low cost price) which move with little friction.

An embodiment of the plunger pump or plunger motor according to the invention is characterized in that a third and a fourth hole are alternately brought into communication with ambient atmosphere or with a connecting hole for a delivery pipe by the plunger, so that no further provisions need to be made for this.

Preferably, the motor casing further has a fifth and a sixth hole which communicate with the ambient atmosphere or with the connecting hole for the delivery pipe and the plunger can alternately establish a communication between the third and the fourth hole and the fifth and the sixth hole. Furthermore, the plunger pump or plunger motor is preferably constructed so that the control valve can establish a communication between the second hole and the ambient atmosphere or the connecting hole for the delivery pipe.

The valve casing preferably has a third further hole which communicates with the ambient atmosphere or with the connecting hole for the delivery pipe and the control valve can establish a communication between the second hole and the third further hole.

An embodiment of the plunger pump or plunger motor according to the invention in which this embodiment is arranged as a plunger pump is characterized in that the drive shaft is connected to a further plunger which is movable in a third cylindrical chamber which is located in a pump casing in which a suction hole or delivery hole is present.

Preferably, the control valve can be alternatively brought into communication with a connecting hole for a suction pipe and the connecting hole for the delivery pipe.

A further embodiment of the plunger pump/plunger motor according to the invention is characterized in that the valve casing is provided with a fourth further hole which communicates with the suction hole or delivery hole, as well as a fifth further hole which communicates with the connecting hole for a suction pipe.

Another advantageous embodiment of the plunger pump or plunger motor according to the invention is characterized in that the third further hole communicates with the connecting hole for a delivery pipe.

A compact and simple configuration of the plunger pump or plunger motor according to the invention is characterized in that the motor casing and valve casing are constituted by a single block which accommodates the first and the second cylindrical chamber, and which block is provided with at least a single connecting hole to which the delivery pipe can be connected, as well as channels which connect the holes and further holes to each other and to the at least one connecting hole.

Another compact and simple configuration of the plunger pump or plunger motor according to the invention is characterized in that the block also constitutes the pump casing and is provided with two further connecting holes to which the suction pipe and the delivery pipe can be connected.

An even simpler configuration of the plunger pump or plunger motor according to the invention is characterized in that the plunger and the further plunger are attached to each other.

BRIEF DESCRIPTION OF THE DRAWINGS

The invention will be described in more detail based on embodiments of the plunger pump or plunger motor according to the invention while reference is made to the appended drawing figures, wherein.

DETAILED DESCRIPTION OF THE INVENTION

Figure 1:
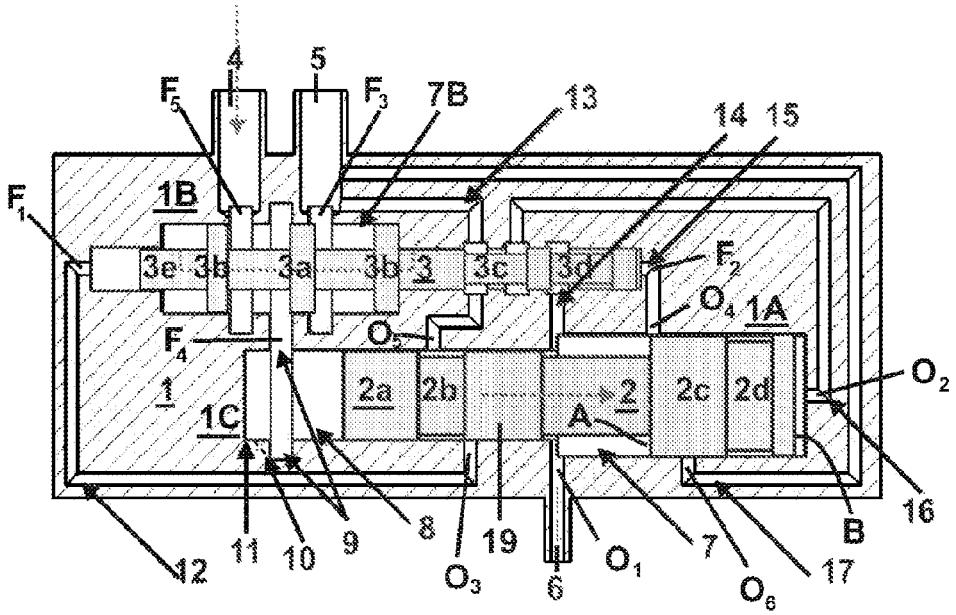
FIG. 1 illustrates a first embodiment of the plunger pump or plunger motor according to the invention arranged as a plunger pump at the end of the suction stroke.

FIGS. 1 to 4 illustrate a first embodiment of the plunger pump or plunger motor according to the invention arranged as a plunger pump shown in different stages of the pumping process. The plunger pump or plunger motor includes a motor casing 1A which accommodates a first cylindrical chamber 7 and a plunger 2 movable in this chamber. At a first side A of the plunger 2 a drive shaft 19 is attached, as a result of which the plunger surface on this first side A is smaller than on an opposite, second side B.

The motor casing 1A is provided with a first hole $O_1$ and a second hole $O_2$ at such a location that in any position of the plunger 2 one hole is available on either side of the plunger.

The plunger pump or plunger motor further includes a valve which has a valve casing 1B which accommodates a second cylindrical chamber 7B and a control valve 3 movable in this chamber. This control valve can provide that a first connecting hole 6 for a delivery pipe which communicates with the second hole $O_2$.

The valve casing 1B is provided with a first further hole $F_1$ and a second further hole $F_2$. These further holes are located at such a spot that in any position of the control valve 3 one further hole is available on either side of the control valve. The motor casing 1A is further provided with a third and a fourth hole $O_3$ and $O_4$. The third hole $O_3$ communicates with the first further hole $F_1$ in the valve casing, and the fourth hole $O_4$ communicates with the second further hole $F_2$ in the valve casing. The third and fourth holes $O_3$ and $O_4$ can be alternatively brought into communication with the first connecting hole 6 for the delivery pipe by the plunger 2.

The first connecting hole 6 for the delivery pipe is in permanent communication with the first hole $O_1$. The third and fourth holes $O_3$ and $O_4$ can be alternatively brought into communication with a second connecting hole 5 for the delivery pipe by the plunger 2.

The motor casing 1A is further provided with a fifth and a sixth hole $O_5$ and $O_6$ which communicate with the second connecting hole 5 for the delivery pipe. The third and the fourth hole $O_3$ and $O_4$ can be alternatively brought into communication with the fifth and sixth hole $O_5$ and $O_6$ respectively by the plunger 2. The control valve 3 can establish a communication between the second hole $O_2$ and the second connecting hole 5 for the delivery pipe.

The valve casing 1B is provided with a third further hole $F_3$ which communicates with the second connecting hole 5 for the delivery pipe. The drive shaft 19 is connected to a further plunger 2*a* which is movable in a third cylindrical chamber 8 which is accommodated in a pump casing 1C in which a suction or delivery hole 9 is present.

The control valve 3 can alternatively establish a communication between the suction hole or delivery hole 9 and a third connecting hole 4 for a suction pipe and the second connecting hole 5 for a delivery pipe. The valve casing 1B is provided with a fourth further hole $F_4$ which communicates with the suction hole or delivery hole 9, as well as a fifth further hole $F_6$ which communicates with the third connecting hole 4 for the suction pipe. The third further hole $F_3$ communicates with the second connecting hole 5 for the delivery pipe.

The motor casing 1A, the valve casing 1B and the pump casing 1C are constituted by a single block 1 in which the first, the second and the third cylindrical chambers 7, 7B and 8 are located. The block 1 is provided with three connecting holes 4, 5 and 6 to which the suction pipe, the delivery pipe and the pressure pipe can be connected. In the block 1 channels 12, 13, 16 and 17 are provided which connect the holes $O_1$, $O_2$, $O_3$, $O_4$, $O_5$ and $O_6$ and further holes $F_1$, $F_2$, $F_3$ and $F_4$ to each other and to the three connecting holes. The plunger 2 and the further plunger 2*a* constitute a whole.

The plunger pump or plunger motor includes no more than two moving parts, that is to say, the plunger 2 with attached to it the further plunger 2*a*, and the control valve 3. The plunger 2 with the further plunger 2*a* attached to it is constituted by two parts, on the left there is the pumping part 2*a* and 2*b* and on the right there is the motor part 2*c* and 2*d*. The plunger and the control valve are coupled hydraulically, thus complex mechanisms and mechanisms subject to wear are absent.

The ratio of pump diameter to motor diameter determines the lift of the pump and/or the number of strokes, thus the pump flow rate. The higher the difference in pressure over the motor with equal pump lift, the higher the pump flow rate.

The feed of the motor takes place through the first connecting hole 6 by means of a medium that has a higher pressure than the pump pressure. This may be liquid, gas or a two phase mixture.

The operation of the plunger pump or plunger motor will be further described with reference to the FIGS. 1 to 4. In FIG. 1 the position of the control valve 3 and plunger 2 is shown substantially at the end of the suction stroke at the moment where the control valve 3 is going to be changed over and the slot 2*b* in plunger 2 starts to open the channel 12 so that a connection is created between channel 12 and channel 13 so that the pressure on the left hand side of the control valve 3 will decrease rapidly to the pump delivery pressure prevailing in the second connecting hole 5 for the delivery pipe.

Figure 2:
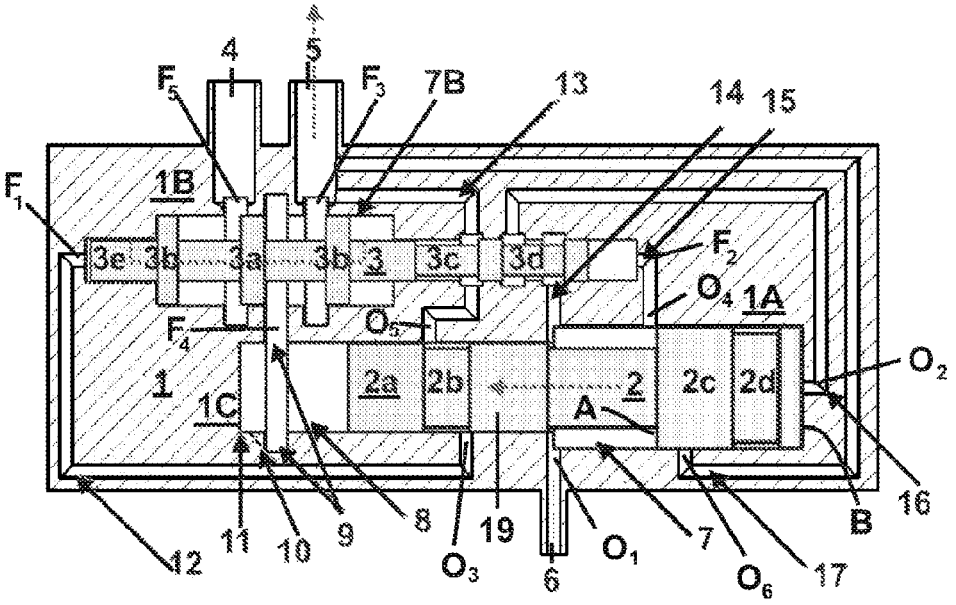
FIG. 2 illustrates the situation shown in FIG. 1 with a switched-over control valve.
Figure 3:
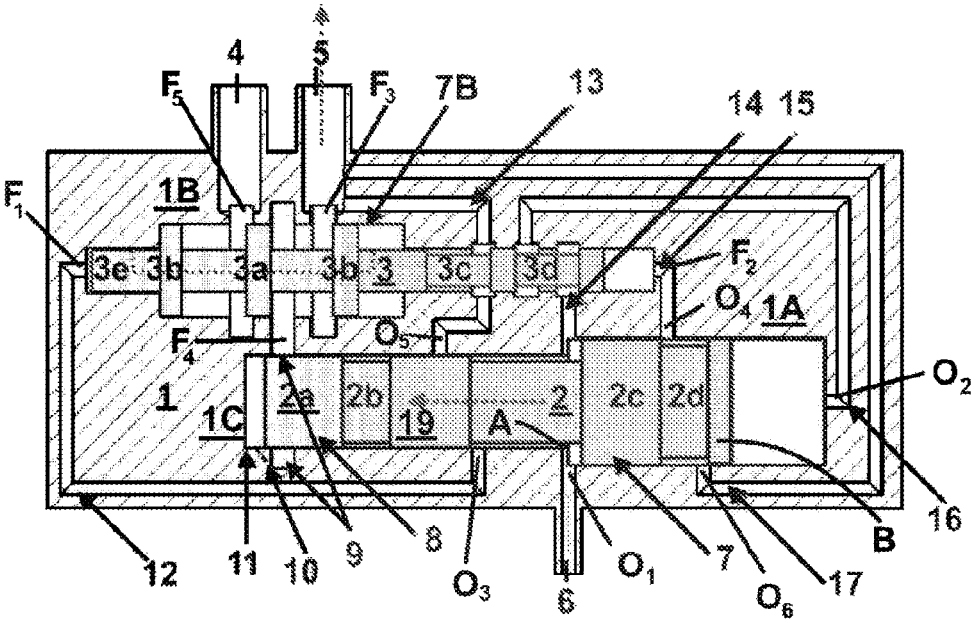
FIG. 3 illustrates the plunger pump or plunger motor at an end of a delivery stroke.
Figure 4:
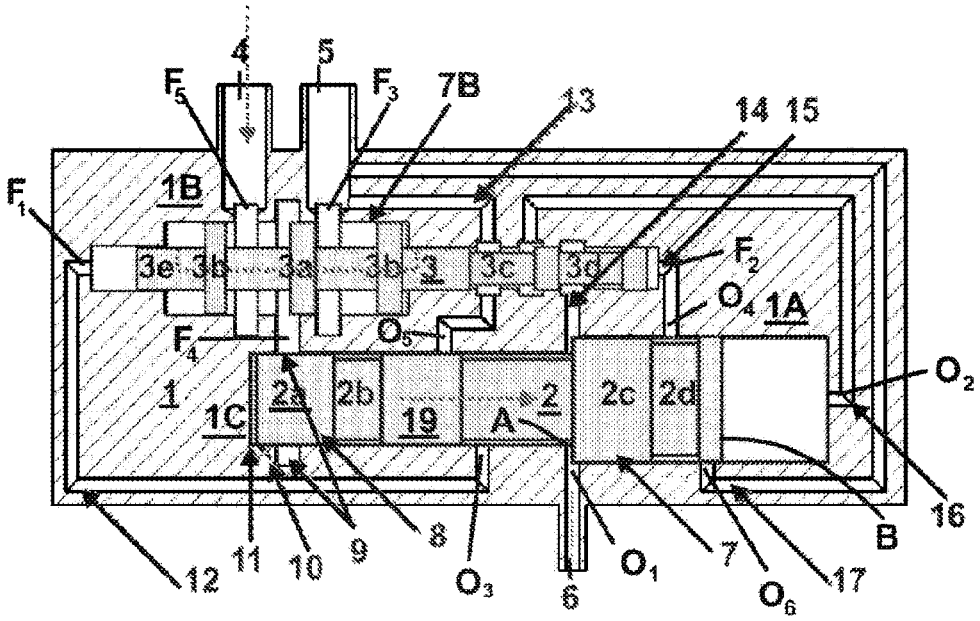
FIG. 4 illustrates the situation shown in FIG. 3 with a switched-over control valve.

A little later the high pressure that prevails in the cylindrical chamber 7 (this chamber forms a hydropneumatic compression spring) comes through channel 16 to the right hand side of the control valve 3 and will switch the latter over in a rapid manner. FIG. 2 shows the situation in switched-over position.

Even before the motor side of the plunger 2 has reached its end position, there is already the higher pressure in channel 16 and the plunger will commence the delivery stroke. In the left hand position there is a constant higher pressure on the motor part of the plunger 2 through slot 3*d* in the control valve and the plunger 2 will push away the liquid in the cylindrical chamber 8 (this is the pump chamber) through the connecting hole 5 for the delivery pipe. By the end of the delivery stroke, see FIG. 3, the plunger 2 is decelerated because the plunger is to push away the liquid in chamber 11 through a narrow channel 10. If the plunger 2 passes the third hole $O_3$ of channel 12, high-pressure medium will flow through the connecting hole 6 in the cylindrical chamber 7 (the compression spring) to the left hand side of the control valve 3. On the right hand side of the control valve 3 the pressure can be lowered through channel 15, slot 2*d*, channel 17 to the connection 5 for the delivery pipe.

The control valve 3 changes over (cf. FIG. 4) and will discharge the motor of the pressure by opening up the channel 16 through slot 3*c* and channel 13 to the connecting hole 5 for the delivery pipe where the pump delivery pressure prevails. The pressure in the cylindrical chamber 7 (compression spring) will now push the plunger 2 to the right and thus draw liquid into the cylindrical chamber 8 (pump chamber) through the connecting hole 4.

Disc 3*a* functions as a change-over cock so as to have the liquid flow correctly during the suction stroke and delivery stroke. The discs 3*b* are used for balancing of pressure. For equalizing the chambers around these discs, the valve has a bore 3*e*.

Figure 5:
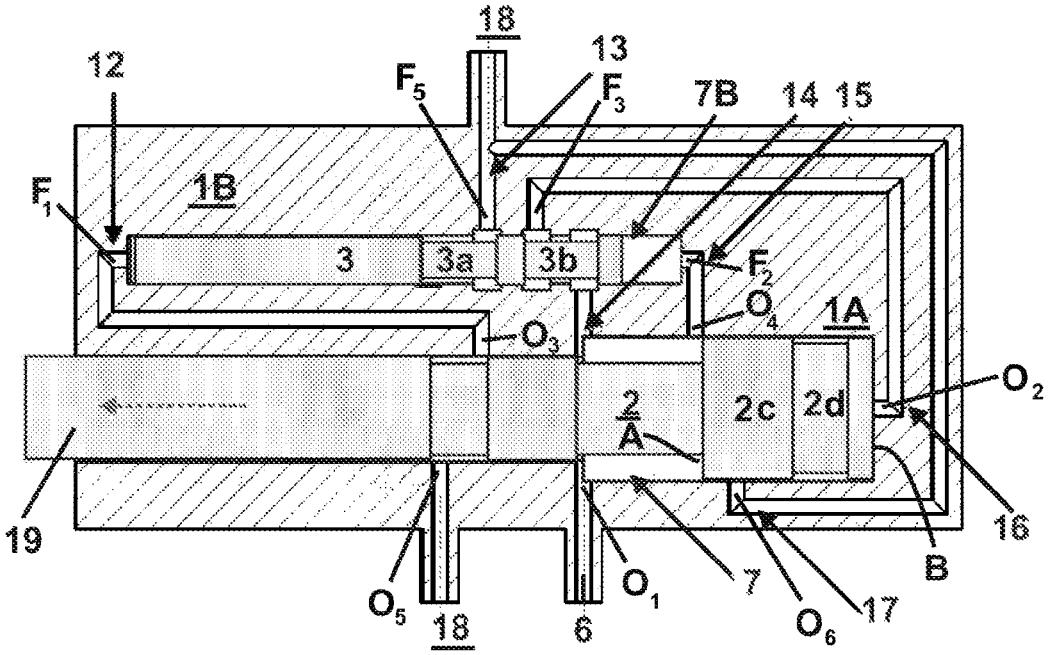
FIG. 5 illustrates a second embodiment of the plunger pump or plunger motor according to the invention arranged as a plunger motor.

FIG. 5 illustrates a second embodiment of the plunger pump or plunger motor according to the invention, arranged as a plunger motor this time. All parts similar to those of the first embodiment or having a similar function to those of the first embodiment are referred to by like reference numerals. In this embodiment the pump section is lacking and the drive shaft 19 extends to beyond the block 1. This drive shaft is driven by the plunger 2 and can in its turn drive a shaft for example via a slotted link mechanism. Furthermore, the third and fourth holes $O_3$ and $O_4$ can alternately be brought into communication with the ambient atmosphere 18 in lieu of with a connecting hole for a delivery pipe.

Though the invention has been described in the foregoing with reference to the drawings, it is appreciated that the invention is not by any manner or means restricted to the embodiment shown in the drawings. The invention also extends to all embodiments deviating from the embodiment shown in the drawings within the spirit and scope defined by the appended claims.

What is claimed is:

1. A plunger pump or a plunger motor, comprising:

a motor casing including a first cylindrical chamber;

a plunger movable in the first cylindrical chamber and including a drive shaft attached to a first plunger side; and a valve, wherein a first plunger surface on the first plunger side is smaller than a second plunger surface on an opposite second plunger side, wherein a first hole and a second hole are provided in the motor casing at such a location that one of the first hole and the second hole is available on either side of the plunger in any position of the plunger, wherein the valve includes a valve casing including a second cylindrical chamber and a control valve movable in the second cylindrical chamber, wherein the valve establishes a communication between a first connecting hole for a delivery pipe and the second hole, wherein the valve casing includes a first further hole and a second further hole at such a location that one of the first further hole and the second further hole is available on either side of the control valve in any position of the control valve, wherein the motor casing includes a third hole and a fourth hole, wherein the third hole communicates with the first further hole in the valve casing and the fourth hole communicates with the second further hole in the valve casing, wherein the third hole and the fourth hole are alternatively connectable with the first connecting hole for the delivery pipe by the plunger, wherein the third hole and the fourth hole are alternatively brought into communication with an ambient atmosphere or with a second connecting hole for the delivery pipe by the plunger, wherein the motor casing further includes a fifth hole and a sixth hole which communicate with the ambient atmosphere or with the second connecting hole for the delivery pipe, and wherein the plunger alternatively establishes a communication between the third hole and the fourth hole and the fifth hole and the sixth hole.

2. A The plunger pump or plunger motor according to claim 1, wherein the delivery pipe feeds the plunger pump or the plunger motor.

3. A plunger pump or a plunger motor, comprising:

a motor casing including a first cylindrical chamber;

a plunger movable in the first cylindrical chamber and including a drive shaft attached to a first plunger side; and a valve, wherein a first plunger surface on the first plunger side is smaller than a second plunger surface on an opposite second plunger side, wherein a first hole and a second hole are provided in the motor casing at such a location that one of the first hole and the second hole is available on either side of the plunger in any position of the plunger, wherein the valve includes a valve casing including a second cylindrical chamber and a control valve movable in the second cylindrical chamber, wherein the valve establishes a communication between a first connecting hole for a delivery pipe and the second hole, wherein the valve casing includes a first further hole and a second further hole at such a location that one of the first further hole and the second further hole is available on either side of the control valve in any position of the control valve, wherein the motor casing includes a third hole and a fourth hole, wherein the third hole communicates with the first further hole in the valve casing and the fourth hole communicates with the second further hole in the valve casing, wherein the third hole and the fourth hole are alternatively connectable with the first connecting hole for the delivery pipe by the plunger, wherein the control valve establishes a communication between the second hole and the ambient atmosphere or a second connecting hole for the delivery pipe, wherein the control valve casing includes a third further hole which communicates with the ambient atmosphere or with the second connecting hole for the delivery pipe, and wherein the control valve establishes a communication between the second hole and the third further hole.

4. The plunger pump or plunger motor according to claim 3, wherein the delivery pipe feeds the plunger pump or the plunger motor.

5. A plunger pump or a plunger motor, comprising:

a motor casing including a first cylindrical chamber;

a plunger movable in the first cylindrical chamber and including a drive shaft attached to a first plunger side; and a valve, wherein a first plunger surface on the first plunger side is smaller than a second plunger surface on an opposite second plunger side, wherein a first hole and a second hole are provided in the motor casing at such a location that one of the first hole and the second hole is available on either side of the plunger in any position of the plunger, wherein the valve includes a valve casing including a second cylindrical chamber and a control valve movable in the second cylindrical chamber, wherein the valve establishes a communication between a first connecting hole for a delivery pipe and the second hole, wherein the valve casing includes a first further hole and a second further hole at such a location that one of the first further hole and the second further hole is available on either side of the control valve in any position of the control valve, wherein the motor casing includes a third hole and a fourth hole, wherein the third hole communicates with the first further hole in the valve casing and the fourth hole communicates with the second further hole in the valve casing, wherein the third hole and the fourth hole are alternatively connectable with the first connecting hole for the delivery pipe by the plunger, wherein a drive shaft is connected to a further plunger which is movable in a third cylindrical chamber which is located in a pump casing in which a suction hole and a delivery hole is present.

6. The plunger pump or plunger motor according to claim 5, wherein the control valve alternatively brings the suction hole or the delivery hole into communication with a third connecting hole for a suction pipe and a second connecting hole for the delivery pipe.

7. The plunger pump or plunger motor according to claim 6, wherein the valve casing is provided with a fourth further hole which communicates with the suction hole or delivery hole, as well as a fifth further hole which communicates with the third connecting hole for the suction pipe.

8. The plunger pump or plunger motor according to claim 6, wherein the third further hole communicates with the second connecting hole for the delivery pipe.

9. The plunger pump or plunger motor according to claim 5, wherein the plunger and the further plunger are attached at each other.

10. The plunger pump or plunger motor according to claim 5, wherein the delivery pipe feeds the plunger pump or the plunger motor.

* * * * *